US008363004B2

(12) United States Patent
Ye et al.

(10) Patent No.: US 8,363,004 B2
(45) Date of Patent: Jan. 29, 2013

(54) METHOD OF DRIVING A LIGHT SOURCE, LIGHT SOURCE DEVICE FOR PERFORMING THE SAME, AND DISPLAY DEVICE HAVING THE LIGHT SOURCE DEVICE

(75) Inventors: Byoung-Dae Ye, Yongin-si (KR); Byung-Choon Yang, Seoul (KR); Gi-Cherl Kim, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 682 days.

(21) Appl. No.: 12/352,255

(22) Filed: Jan. 12, 2009

(65) Prior Publication Data

US 2009/0225021 A1 Sep. 10, 2009

(30) Foreign Application Priority Data

Mar. 5, 2008 (KR) ..... 2008-20279

(51) Int. Cl.
*G09G 3/36* (2006.01)
*H05B 37/02* (2006.01)

(52) U.S. Cl. ..... 345/102; 315/291

(58) Field of Classification Search ..... None
See application file for complete search history.

(56) References Cited

U.S. PATENT DOCUMENTS

| | | | | |
|---|---|---|---|---|
| 7,119,498 | B2 * | 10/2006 | Baldwin et al. | 315/291 |
| 7,791,584 | B2 * | 9/2010 | Korcharz et al. | 345/101 |
| 7,800,876 | B2 * | 9/2010 | Peker et al. | 361/86 |
| 7,999,486 | B2 * | 8/2011 | Wang et al. | 315/291 |
| 2007/0195024 | A1 | 8/2007 | Korcharz et al. | |
| 2009/0021187 | A1 * | 1/2009 | Bhagat | 315/297 |
| 2009/0040197 | A1 * | 2/2009 | Scheibe | 345/204 |

* cited by examiner

*Primary Examiner* — K. Wong
(74) *Attorney, Agent, or Firm* — F. Chau & Associates, LLC

(57) ABSTRACT

A method of driving light sources controls amounts of light from light-emitting diode (LED) strings based on pulse signals to operate the LED strings connected in parallel. Voltages are synchronized with the pulse signals at input terminals of control circuits to detect the voltages, the control circuits being connected to the LED strings and controlling resistance variations of the LED strings. The operation of the LED strings is stopped when the detected voltage is out of a predetermined allowable voltage range due to a short-circuited LED. Therefore, a light source device may be protected by stopping the operation of the LED strings.

16 Claims, 9 Drawing Sheets

METHOD OF DRIVING A LIGHT SOURCE, LIGHT SOURCE DEVICE FOR PERFORMING THE SAME, AND DISPLAY DEVICE HAVING THE LIGHT SOURCE DEVICE

CROSS-REFERENCE TO RELATED APPLICATION

This application claims priority under 35 U.S.C. §119 to Korean Patent Application No. 2008-20279, filed on Mar. 5, 2008 in the Korean Intellectual Property Office (KIPO), the contents of which are herein incorporated by reference in their entirety.

BACKGROUND OF THE INVENTION

1. Technical Field

The present disclosure relates to a method of driving a light source, a light source device for performing the method, and a display device having the light source device. More particularly, the present disclosure relates to a method of driving a light source for local dimming driving, a light source device performing the method and a display device having the light source device.

2. Discussion of Related Art

Generally, liquid crystal display (LCD) devices have thinner thickness, lighter weight, and lower power consumption than other types of display devices. Thus, LCD devices are being widely used not only for monitors, notebook computers, and cellular phones, but also for wide-screen televisions. An LCD device includes an LCD panel displaying images using the light transmissivity property of a liquid crystal layer, and a backlight assembly providing the LCD panel with light.

The backlight assembly includes a light source that generates light. For example, the light source may be a cold cathode fluorescent lamp (CCFL), a hot cathode fluorescent lamp (HCFL) or a light-emitting diode (LED). The LED is used as a light source for an LCD panel, because the LED has low power consumption and high color reproducibility.

Recently, a local dimming method dividing the LCD panel into a plurality of regions and controlling amounts of light from the backlight based on the gray level of an image displayed in each of the regions has been developed in order to improve the contrast ratio of the image displayed on the LCD device. The local dimming method reduces amounts of light from LEDs by reducing the amount of driving current provided to the LEDs that are located in a region displaying a darker image than other regions. Additionally, the local dimming method increases the amounts of light from the LEDs by increasing the amount of the driving current provided to the LEDs that are located in a region displaying a brighter image than other regions.

As described above, the backlight assembly includes a plurality of LED strings and a multichannel current controller for providing a driving current to the LED strings connected to each other in parallel, wherein LEDs are connected in series in each of the LED strings, using the local dimming method.

The multichannel current controlling circuit generally controls resistance variations among the LED strings so that the driving currents flowing through the LED strings are controlled to be the same. When an LED is shorted in one of the LED strings, the multichannel current controlling circuit consumes an amount of power corresponding to the shorted LED by producing heat in order to maintain the driving current. The shorted LED often damages the multichannel current controlling circuit.

SUMMARY OF THE INVENTION

Exemplary embodiments of the present invention provide a method of driving light sources so as to protect a light source device.

Exemplary embodiments of the present invention also provide a light source device for performing the above-mentioned method.

Exemplary embodiments of the present invention also provide a display device having the above-mentioned light source device.

In an exemplary embodiment of the present invention, there is provided a method of driving a light source, in which amounts of light from light-emitting diode (LED) strings are controlled based on pulse signals used to operate the LED strings connected in parallel. Voltages are synchronized with the pulse signals at output terminals of the LED strings and the voltages are detected. Control circuits are connected to the output terminals of the LED strings to control resistance variations among the LED strings. The operation of the LED strings is stopped when the detected voltages are out of a predetermined allowable voltage range.

In an exemplary embodiment of the present invention, a light source device includes a light source, a pulse generator and a multichannel current controller. The light source includes LED strings connected in parallel. The pulse generator generating pulse signals controls amounts of light emitted from the LED strings. The multichannel current controller is connected to output terminals of the LED strings, and controls the amounts of light emitted from the LED strings based on the pulse signals and resistance variations among the LED strings. The defect detector is connected to the output terminals of the LED strings, and is synchronized with the pulse signals to detect any short-circuit defects in the LED strings.

In an exemplary embodiment of the present invention, a display device includes a display panel, a local dimming controller, a light source, a pulse generator, a multichannel current controller and a defect detector. The display panel displays a frame image. The local dimming controller divides the frame image into blocks and generates dimming control signals based on the luminance of image signals corresponding to the blocks. The light source includes LED strings connected in parallel corresponding to the blocks. The pulse generator generates pulse signals controlling amounts of light from the LED strings based on the dimming control signals. The multichannel current controller is connected to output terminals of the LED strings, and controls the amounts of light from the LED strings based on the pulse signals and resistance variations among the LED strings. The defect detector is connected to output terminals of the LED strings and is synchronized with the pulse signals to detect short-circuit defects in the LED strings.

According to exemplary embodiments of the present invention, short-circuit defects of an LED may be detected while the light source device is driven, so that a light source device and a display device having the light source device may be protected by blocking a driving current provided to a light source when the short-circuit defects are present.

BRIEF DESCRIPTION OF THE DRAWINGS

Exemplary embodiments of the present invention will be understood in more detail from the following descriptions taken in conjunction with the accompanying drawings, in which.

DETAILED DESCRIPTION OF EXEMPLARY EMBODIMENTS

Exemplary embodiments of the present invention are described more fully hereinafter with reference to the accompanying drawings, in which exemplary embodiments of the invention are shown. This invention may, however, be embodied in many different forms and should not be construed as limited to the embodiments set forth herein. Rather, these exemplary embodiments are provided so that this disclosure will be thorough and complete, and will fully convey the scope of the invention to those of ordinary skill in the art.

Hereinafter, exemplary embodiments of the present invention will be explained in detail with reference to the accompanying drawings.

Figure 1:
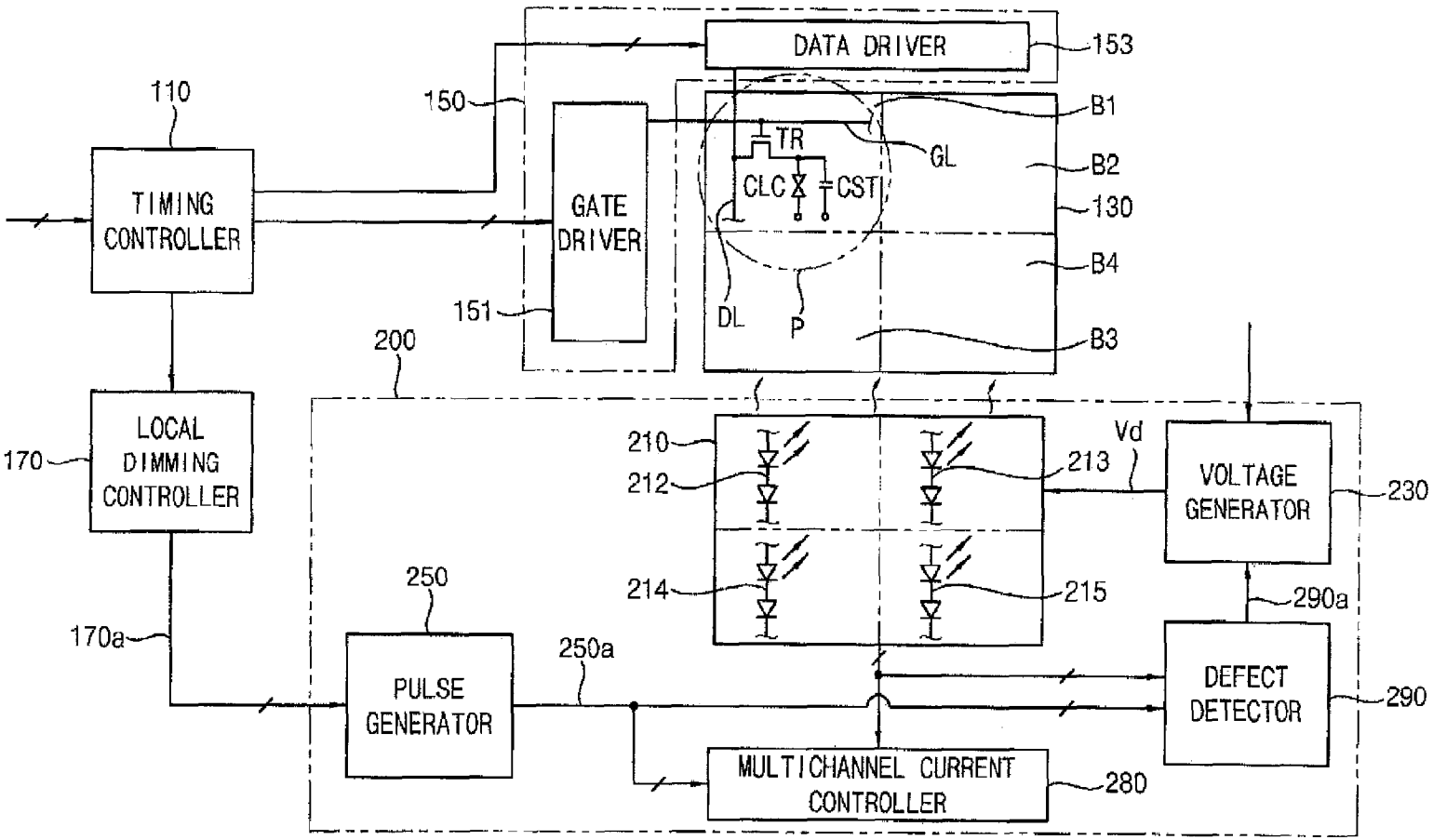
FIG. 1 is a block diagram illustrating a display device in accordance with an exemplary embodiment of the present invention.

FIG. 1 is a block diagram illustrating a display device in accordance with an exemplary embodiment of the present invention.

Referring to FIG. 1, a display device includes a timing controller 110, a display panel 130, a panel driver 150, a local dimming controller 170, and a light source device 200.

The timing controller 110 receives a control signal and an image signal from an external device (not shown). The control signal may include a vertical synchronizing signal, a horizontal synchronizing signal, a main clock signal, and a data enable signal. The vertical synchronizing signal represents a time required for displaying one frame. The horizontal synchronizing signal represents a time required for displaying one line of the frame. Thus, the horizontal synchronizing signal includes pulses corresponding to the number of pixels included in one line. The data enable signal represents a time required for supplying the pixel with data. The timing controller 110 generates a timing control signal controlling a driving timing of the display device based on the control signal. The timing control signal may include a clock signal, a horizontal start signal, and a vertical start signal.

The display panel 130 includes a plurality of pixels, and each of the pixels P includes a switching element TR electrically connected to a gate line GL and a data line DL, a liquid crystal capacitor CLC electrically connected to the switching element TR, and a storage capacitor CST electrically connected to the switching element TR. In an exemplary embodiment, the switching element TR may compromise a thin-film transistor (TFT).

The panel driver 150 includes a gate driver 151 and a data driver 153. The gate driver 151 outputs a gate signal to the gate line GL based on the timing control signal provided from the timing controller 110. The data driver 153 outputs a data signal to the data line DL based on the image signal and the timing control signal provided from the timing controller 110.

The local dimming controller 170 analyzes the image signal provided from the timing controller 110 to generate a dimming control signal 170*a*. A frame image displayed on the display panel 130 may include a plurality of blocks in order to drive the light source device 200 using a local dimming method. For example, the frame image may include a first block B1, a second block B2, a third block B3, and a fourth block B4. The local dimming controller 170 analyzes an image signal of the image frame to generate a respective light luminance value for each of the first to fourth blocks B1, B2, B3, and B4. The local dimming controller 170 determines dimming levels and generates dimming control signals 170*a* corresponding to the first to fourth blocks B1, B2, B3, and B4.

The light source device 200 includes a light source 210, a voltage generator 230, a pulse generator 250, a multichannel current controller 280, and a defect detector 290.

The light source 210 includes a plurality of light-emitting diode (LED) strings. For example, the LED strings include a first LED string 212, a second LED string 213, a third LED string 214, and a fourth LED string 215 in correspondence respectively with the first to fourth blocks B1, B2, B3, and B4.

Alternatively, the light source 210 further includes a printed circuit board (PCB) (not shown) having the first through fourth LED strings 212, 213, 214, and 215 mounted thereon. For example, the LED strings 212, 213, 214, and 215 may be mounted at positions corresponding to the first to fourth blocks B1, B2, B3, and B4 on the PCB. Alternatively, the LED strings 212, 213, 214, and 215 may be mounted on a plurality of PCBs. Here, the PCBs may be disposed in correspondence with the first to fourth blocks B1, B2, B3, and B4. For example, the first LED string 212 may be formed below the first block B1, and the second LED string 213 may be formed below the second block B2. Moreover, the third LED string 214 may be formed on the third block B3, and the fourth LED string 215 may be formed on the fourth block B4.

The voltage generator 230 boosts up or down a voltage that is externally provided into a driving voltage Vd driving the light source 210. For example, the voltage generator 230 may be a direct current-direct current (DC-DC) converting circuit which boosts up a direct current (DC) voltage externally provided into an increased direct current voltage.

The pulse generator 250 generates pulse signals 250*a* that are pulse width modulated signals based on the received dimming control signals 170*a* provided from the local dimming controller 170. The pulse generator 250 respectively outputs the pulse signals 250*a* to the multichannel current controller 280 and the defect detector 290.

The multichannel current controller 280 is electrically connected to the LED strings 212, 213, 214, and 215 of the light source 210 to control resistance variations among the LED strings 212, 213, 214, and 215, so that a substantially identical driving current may flow through the LED strings 212, 213, 214, and 215.

Moreover, the multichannel current controller 280 may control amounts of light generated from the LED strings 212, 213, 214, and 215 based on the pulse signals 250*a*. Therefore, the light source 210 generates light corresponding to light luminance of an image displayed on the first to fourth blocks B1, B2, B3, and B4.

The defect detector 290 is synchronized with the pulse signals 250*a* to detect short-circuit defects by detecting voltages at output terminals of the LED strings 212, 213, 214 and 215 in real time. The defect detector 290 generates a voltage control signal 290*a* for controlling the voltage generator 230 to block the driving voltage Vd when the short-circuit defects are generated.

For example, the defect detector 290 outputs the voltage control signal 290*a* having a low voltage when the detected voltages at the output terminals of the LED strings 212, 213, 214, and 215 are within a predetermined allowable voltage range, and the voltage control signal 290*a* having a high voltage when the detected voltages at the output terminals of the LED strings 212, 213, 214, and 215 are out of the predetermined allowable voltage range. Therefore, the voltage generator 230 generates the driving voltage Vd when the voltage control signal 290*a* having a low voltage is provided to the voltage generator 230, and blocks the driving voltage Vd when the voltage control signal 290*a* having a high voltage is provided to the voltage generator 230. Thus, the light source 210 is not operated when the short-circuit defects are detected.

Figure 2:
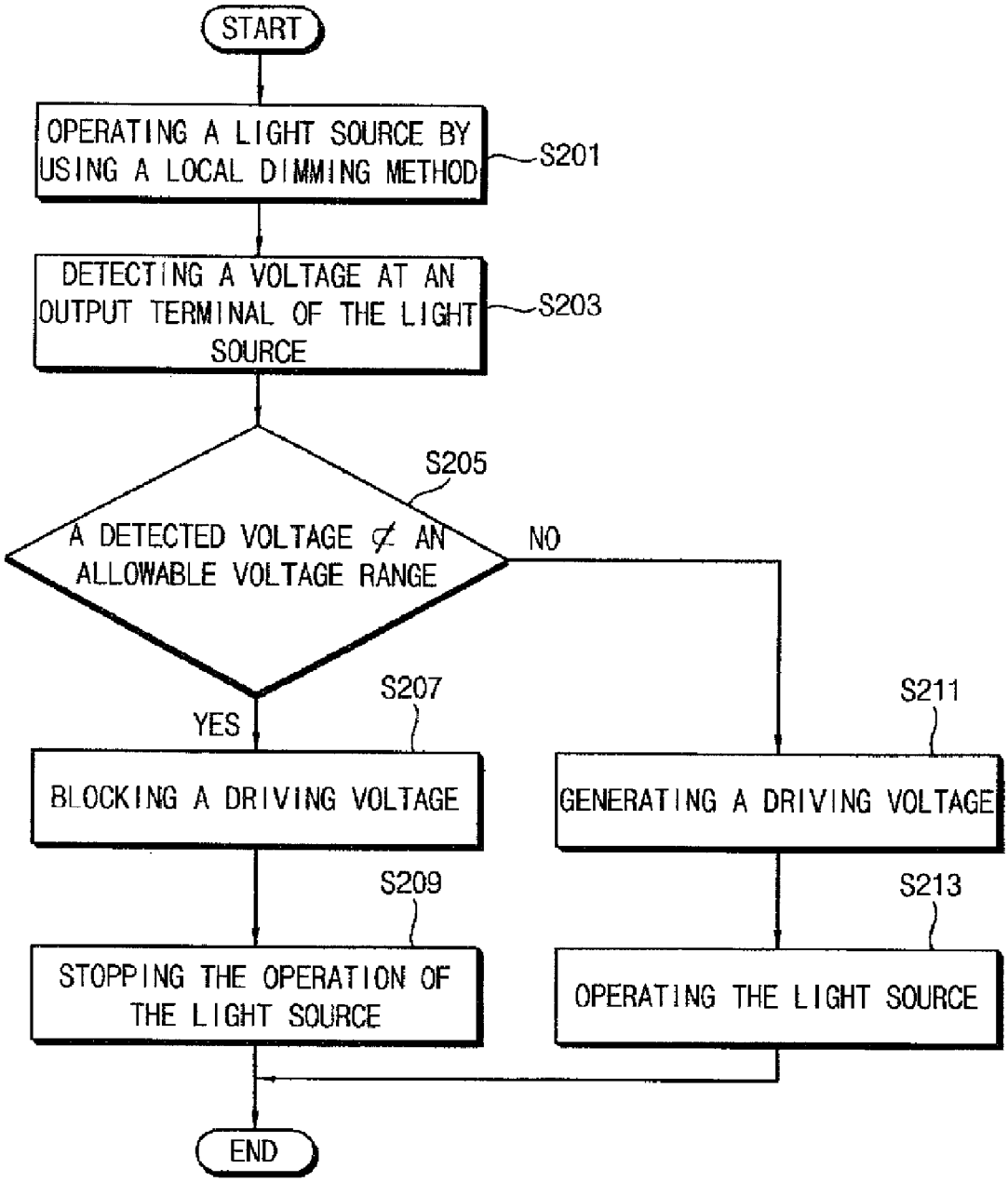
FIG. 2 is a flowchart illustrating a method of driving light sources of a light source device shown in FIG. 1.

FIG. 2 is a flowchart illustrating a method of driving light sources of a light source device shown in FIG. 1.

Referring to FIGS. 1 and 2, the voltage generator 230 generates the driving voltage Vd to provide the light source 210 with the driving voltage Vd. The light source 210 includes the plurality of LED strings 212, 213, 214, and 215. The driving voltage Vd is provided to input terminals of the LED strings 212, 213, 214, and 215. The pulse generator 250 provides the multichannel current controller 280 with the pulse signals 250*a* to control the light luminance of the LED strings 212, 213, 214, and 215. Thus, the LED strings 212, 213, 214, and 215 are operated to respectively generate light having brightness corresponding to the first to fourth blocks B1, B2, B3 and B4 of the display panel 130. Accordingly, the light source 210 may be operated using a local dimming driving method (step S201).

The defect detector 290 synchronizes the voltages at the output terminals of the LED strings 212, 213, 214, and 215 that are electrically connected to the multichannel current controller (step S203).

The voltage detected at the output terminals is determined to be either within or outside of the predetermined allowable voltage range (step S205). The LED strings 212, 213, 214, and 215 are normally driven when the detected voltage is within the predetermined allowable voltage range; however, the LED strings 212, 213, 214, and 215 are determined to have short-circuit defects when the detected voltage is outside of the predetermined allowable voltage range.

For example, assuming that the allowable voltage range is below a predetermined first reference voltage showed at Vp in FIG. 3, and the defect detector 290 provides the voltage control signal 290*a* having a high voltage to the voltage generator 230 when the detected voltage is greater than or equal to the reference voltage showed at Vp in FIG. 3. Then, the voltage generator 230 blocks the driving voltage Vd provided to the light source 210 based on the voltage control signal 290*a* having a high voltage (step S207). Therefore, the operation of the light source 210 is stopped (step S209).

Figure 3:
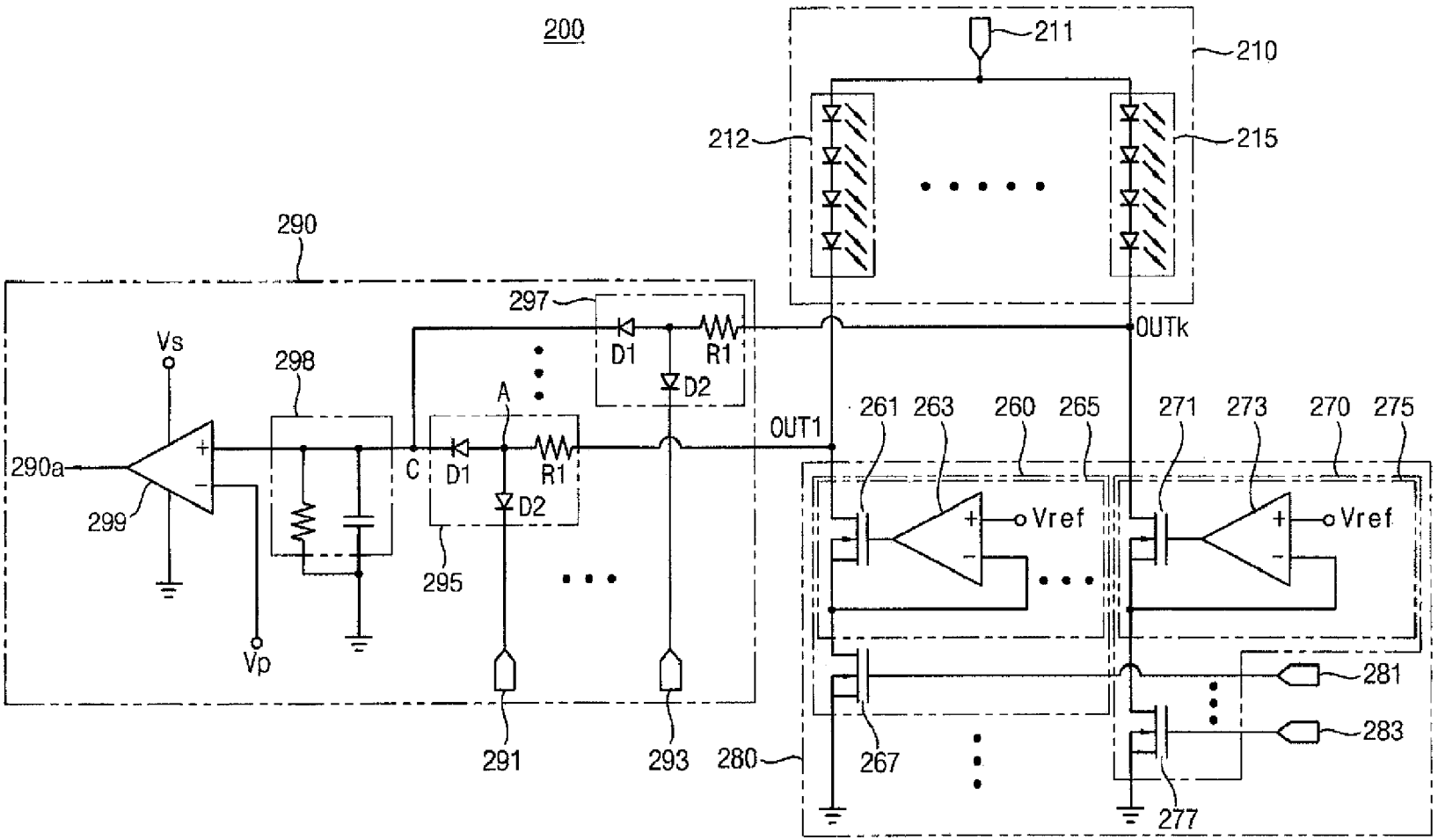
FIG. 3 is a circuit diagram illustrating a light source device shown in FIG. 1.

The defect detector 290 provides the voltage control signal 290*a* having a low voltage to the voltage generator 230, however, when the detected voltage is lower than the first reference voltage shown at Vp in FIG. 3. Then, the voltage generator 230 generates the driving voltage Vd provided to the light source 210 based on the voltage control signal 290*a* having a low voltage (step S211). Therefore, the light source 210 may operate normally (step S213).

Accordingly, the defect detector 290 detects the short-circuit defects in real time when the light source 210 operates, and causes the light source 210 to stop operating by controlling the voltage generator 230.

FIG. 3 is a circuit diagram illustrating an exemplary embodiment of a light source device shown in FIG. 1.

Referring to FIGS. 1 and 3, the light source device 200 includes the light source 210, the multichannel current controller 280 and the defect detector 290.

The light source 210 includes LED strings 212 through 215 and an input terminal 211 receiving the driving voltage Vd. For example, the first LED string 212 to the (k)-th LED string 215 are connected in parallel, and the input terminal 211 is connected to first terminals of the first through (k)-th LED strings 212 through 215. Each of the strings 212 through 215 includes a number of LEDs connected in series.

The multichannel current controller 280 includes a plurality of control circuits 260 through 270 respectively connected to the output terminals of the first through (k)-th LED strings 212 through 215, and a plurality of input terminals 281 through 283. For example, the first through (k)-th input terminals 281 through 283 receive pulse signals 250*a* shown in FIG. 1. The first through (k)-th control circuits 260 through 270 control a fixed driving current provided to the LED strings 212 through 215 and control amounts of light from the LED strings 212 through 215 based on the pulse signals 250*a* shown in FIG. 1.

The first control circuit 260 includes a first current control circuit 265 and a first driving transistor 267. The (k)-th control circuit 270 includes a (k)-th current control circuit 275 and a (k)-th driving transistor 277. For example, the first current control circuit 265 includes a control transistor 261 and an operational amplifier 263. The control transistor 261 includes a source electrically connected to the output terminal of the first LED string 212. The control transistor 261 includes a drain electrically connected to a source of the first driving transistor 267.

The operational amplifier 263 includes a first input terminal receiving a second reference voltage Vref. The operational amplifier 263 includes a second input terminal electrically connected to the drain of the control transistor 261 and receives an output voltage from the drain of the control transistor 261. The operational amplifier 263 includes an output terminal electrically connected to a gate of the control transistor 261 and controls the control transistor 261. The operational amplifier 263 compares the output voltage with the second reference voltage Vref and controls the output voltage to follow the second reference voltage Vref. Thus, the driving current provided to the first LED string 212 is controlled to have a fixed value.

The control transistor 261 performs as a variable resistor whose resistance value is controlled by the operational amplifier 263. For example, the resistance value increases when the driving current provided to the first LED string 212 is greater than or equal to the second reference voltage Vref in order to lower the driving current. The resistance value falls, however, when the driving current provided to the first LED string 212 is less than the second reference voltage Vref in order to increase the driving current.

The first driving transistor 267 includes the source connected to the drain control transistor 261 included in the first current control circuit 265, a drain connected to ground, and a gate connected to the input terminal 281. Accordingly, the first driving transistor 267 controls the on/off state of the first LED string 212 in order to control the amount of light from the first LED string 212 based on the pulse signals provided through the input terminal 281.

Circuit structures and the operation of the second current control circuit (not shown) through the (k)-th current control circuit 275 are the same as those described above, and thus further repetitive explanation concerning the second current control circuit (not shown) through the (k)-th current control circuit 275 will be omitted. Therefore, a fixed driving current is provided to the first through (k)-th LED strings 212 through 215 being controlled by the first through (k)-th current control circuits 265 through 275.

Additionally, circuit structures and the operation of the second driving transistor (not shown) through (k)-th driving transistor 277 are the same as those described above, and thus further repetitive explanation concerning the second driving transistor (not shown) through (k)-th driving transistor 277 will be omitted. Therefore, the first through (k)-th LED strings 212 through 215 operate using a local dimming method based on the luminance value of the image displayed on the display panel 130.

The defect detector 290 includes first through (k)-th input terminals 291 through 293, a plurality of detection circuits 295 through 297, a filter circuit 298 and a comparator 299.

The first through (k)-th input terminals 291 through 293 receive the pulse signals 250*a* shown in FIG. 1.

The detection circuits 295 through 297 are electrically connected in parallel, and the detection circuits 295 through 297 include first terminals electrically connected to output terminals OUT1 through OUTk of the first through (k)-th LED strings 212 through 215, respectively, and second terminals electrically connected to a common node C.

For example, the first detection circuit 295 includes a first resistor R1 electrically connected to the output terminal OUT1 of the first LED string 212, and a first diode D1 including a cathode electrically connected to the first resistor R1 and an anode electrically connected to the input of the filter circuit 298. Additionally, the first detection circuit 291 may include a second diode D2 including an anode electrically connected to the first resistor R1 and the first diode D1 at node A and a cathode electrically connected to the input terminal 291.

The first detection circuit 295 detects a voltage at the output terminal OUT1 of the first LED string 212 based on the pulse signal received at the input terminal 291.

Circuit structures and the operation of the second detection circuit (not shown) through the (k)-th detection circuit 297 are the same as those described above, and thus further repetitive explanation concerning the second detection circuit (not shown) through the (k)-th detection circuit 297 will be omitted.

The filter circuit 298 includes a resistor and a capacitor. The filter circuit 298 is commonly connected to the second terminals of the first through (k)-th detection circuits 295 through 297 at the common node C. The filter circuit 298 removes noise in the detected voltage.

The comparator 299 includes a first input terminal receiving the detected voltage, a second input terminal receiving the first reference voltage Vp, and an output terminal providing the voltage control signal 290*a* that is a resultant output signal from the comparator 299. The comparator 299 outputs the voltage control signal 290*a* having a high voltage when the detected voltage is greater than or equal to the first reference voltage Vp, and the voltage control signal 290*a* having a low voltage of about 0 V when the detected voltage is less than the first reference voltage Vp. Accordingly, the comparator 299 determines that the LED strings operate normally when the detected voltage is within an allowable voltage range that is less than the first reference voltage Vp to output the control signal 290*a* having a low voltage of about 0 V. The comparator 299 determines that the LED strings have short-circuit defects, however, when the detected voltage is out of the allowable voltage range that is greater than or equal to the first reference voltage Vp to output the control signal 290*a* having a high voltage Vs.

Figure 4A:
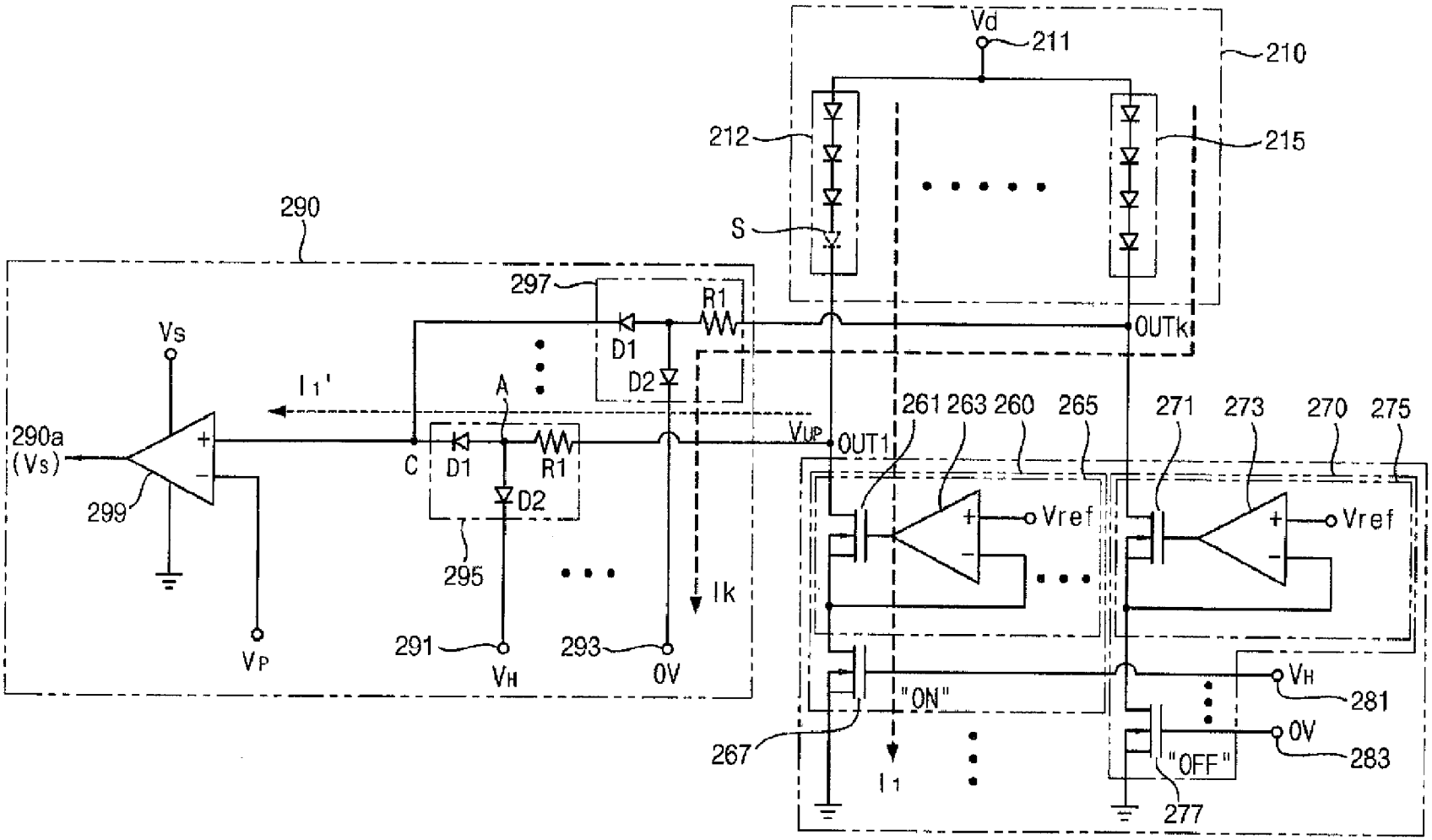
FIGS. 4A and 4B are circuit diagrams illustrating a light source device having short-circuit defects.
Figure 4B:
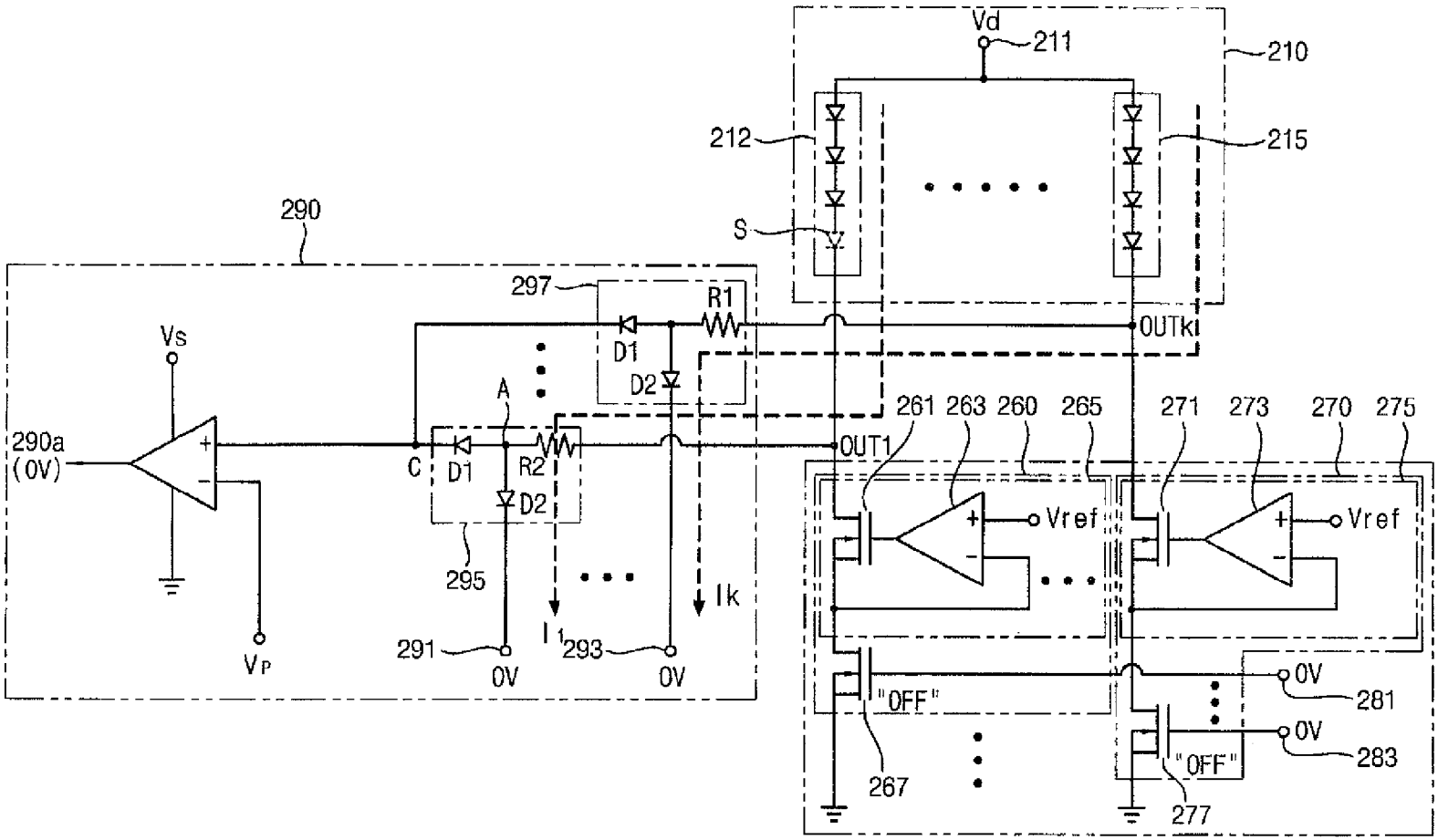
Figure 5:
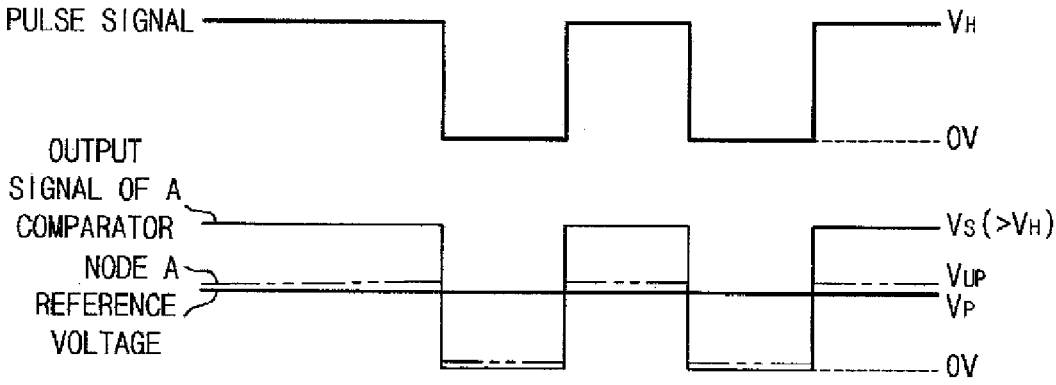
FIG. 5 is a waveform diagram illustrating an input signal and an output signal of the light source device having short-circuit defects.

FIGS. 4A and 4B are circuit diagrams illustrating a light source device having short-circuit defects, and FIG. 5 is a waveform diagram illustrating an input signal and an output signal of the light source device having short-circuit defects.

Referring to FIGS. 4A and 4B, the first LED string 212 in the first light source 210 has a short-circuit defect S where an LED in the first LED string has become shorted. The first through (k)-th LED strings 212 through 215 in the light source 210 each receive the driving voltage Vd.

Input terminals 281 and 283 of the multichannel current controller 280 receive pulse signals at substantially the same time. Additionally, the pulse signals are also provided to the input terminals 291 and 293 of the defect detector 290 at substantially the same time.

Initially, referring to FIGS. 4A and 5, the operation of the light source device will be described when a first pulse signal having a high voltage VH is provided to the light source device based on the first LED string 212, and when a second pulse signal having a low voltage of about 0 V is provided to the light source device based on the (k)-th LED string 215.

The first driving transistor 267 of the first control circuit 260 that is electrically connected to the first LED string 212 receives the first pulse signal having a high voltage VH, and the (k)-th driving transistor 277 of the (k)-th control circuit 270 is electrically connected to the (k)-th LED string 215 and receives the (k)-th pulse signal having a low voltage of about 0 V. Accordingly, the first driving transistor 267 is turned on, and the (k)-th driving transistor 277 is turned off. Thus, the first LED string 212 operates to generate light; however, the (k)-th LED string 215 may not operate. The first LED string 212 and the (k)-th LED string 215 are operated using a local dimming method.

The first detection circuit 295 electrically connected to the output terminal OUT1 of the first LED string 212 receives the first pulse signal having a high voltage VH, and the (k)-th detection circuit 297 electrically connected to the output terminal OUTk of the (k)-th LED string 215 receives the (k)-th pulse signal having a low voltage of about 0 V.

A resistance value of the first LED string 212 that has a short-circuit defect S, however, is lower than a resistance value of the first LED string 212 that is normal. Thus, a first driving current I1 through the first LED string 212 is greater than or equal to a reference current. The first current control circuit 265 controls the driving current I1, which is greater than or equal to the reference current, to follow the reference current.

For example, the operational amplifier 263 compares the output voltage of the control transistor 261 and the second reference voltage Vref and controls the output voltage to follow the second reference voltage Vref. Thus, the first driving current I1 is controlled to follow the reference current. Accordingly, the first current control circuit 265 controls a resistance value of the control transistor 261 to be increased in order to lower the first driving current I1 to the reference current. A voltage at the source of the control transistor 261 included in the first control circuit 260 increases when the resistance value of the control transistor 261 increases. The output terminal OUT1 of the first LED string 212 has a boosted voltage Vup that is an increased amount of voltage corresponding to the number of shorted LEDs that are present. Additionally, a fixed current I1' flows through the output terminal OUT1 of the first LED string 212 and through the first diode D1 of the first detection circuit 295 when the first detection circuit 295 receives the first pulse signal having a high voltage VH. Accordingly, a voltage at node A in the first control circuit 295 is almost identical to the boosted voltage Vup.

The driving voltage Vd is provided to the (k)-th LED string 215, the (k)-th driving transistor 275 is turned off, and the (k)-th pulse signal having a low voltage of about 0 V is provided to the (k)-th detection circuit 297. The (k)-th driving current Ik flowing through the (k)-th LED string 215 flows through the second diode D2 in the (k)-th detection circuit 297, and through the (k)-th input terminal 293 receiving the (k)-th pulse signal having a low voltage of about 0 V. Thus, a voltage at the output terminal OUTk of the (k)-th LED string 215 is almost 0 V.

The first and (k)-th detection circuits 295 and 297 output the boosted voltage Vup as the detected voltage. In this exemplary embodiment, the boosted voltage Vup is a voltage at the common node. The comparator 299 outputs the voltage control signal 290*a* having a high voltage Vs when the detected voltage Vup, which is greater than or equal to the first reference voltage Vp, is provided.

The voltage generator shown at 230 in FIG. 1 stops operating the first through (k)-th LED strings 212 through 215 by blocking the driving voltage Vd based on the voltage control signal 290*a* having a high voltage Vs.

Then, referring to FIGS. 4B and 5, the operation of the light source device will be described when the first pulse signal having a low voltage of about 0 V is provided to the light source device based on the first LED string 212 having the short-circuit defect S.

The operation of the light source device when the (k)-th pulse signal having a low voltage of about 0 V is provided to the light source device is substantially the same as that described in relation to FIG. 4A, and thus further repetitive explanation concerning the operation of the light source device when the (k)-th pulse signal having a low voltage of about 0 V is provided to the light source device will be omitted.

The first driving transistor 267 in the first control circuit 260 electrically connected to the first LED string 212 receives the first pulse signal having a low voltage of about 0 V. Thus, the first driving transistor 267 is turned off and the first LED string 212 may not operate and may not generate light. The first detection circuit 295 electrically connected to the output terminal OUT1 of the first LED string 212 receives the first pulse signal having a low voltage of about 0 V. The driving voltage Vd is discharged through the first LED string 212, the second diode D2 in the first detection circuit 295, and the input terminal 291 forming a current route I1. A voltage at the node A in the first detection circuit 295 is about 0 V.

Accordingly, the voltages at the output terminals OUT1 and OUTk detected from the first and (k)-th detection circuits 295 and 297 are almost about 0 V. The comparator 299 outputs the voltage control signal 290*a* having a low voltage of about 0 V when the detected voltage of about 0 V that is less than the first reference voltage Vp is provided to the comparator 299. Therefore, the first LED string 212 may not operate when the first pulse signal having a low voltage of about 0 V is provided to the first LED string 212 having the short-circuit defect, and thus the defect detector 290 may not detect the defects.

The voltage generator 230 generates the driving voltage Vd to provide the driving voltage Vd to the first and (k)-th LED strings 212 and 215 based on the voltage control signal 290*a* having a low voltage of about 0 V.

A level of the first reference voltage Vp of the comparator 299 is determined in order to detect at least one shorted LED as described above. The level of the first reference voltage Vp of the comparator 299 may be increased, however, in order to detect two, or more than two, shorted LEDs.

Figure 6A:
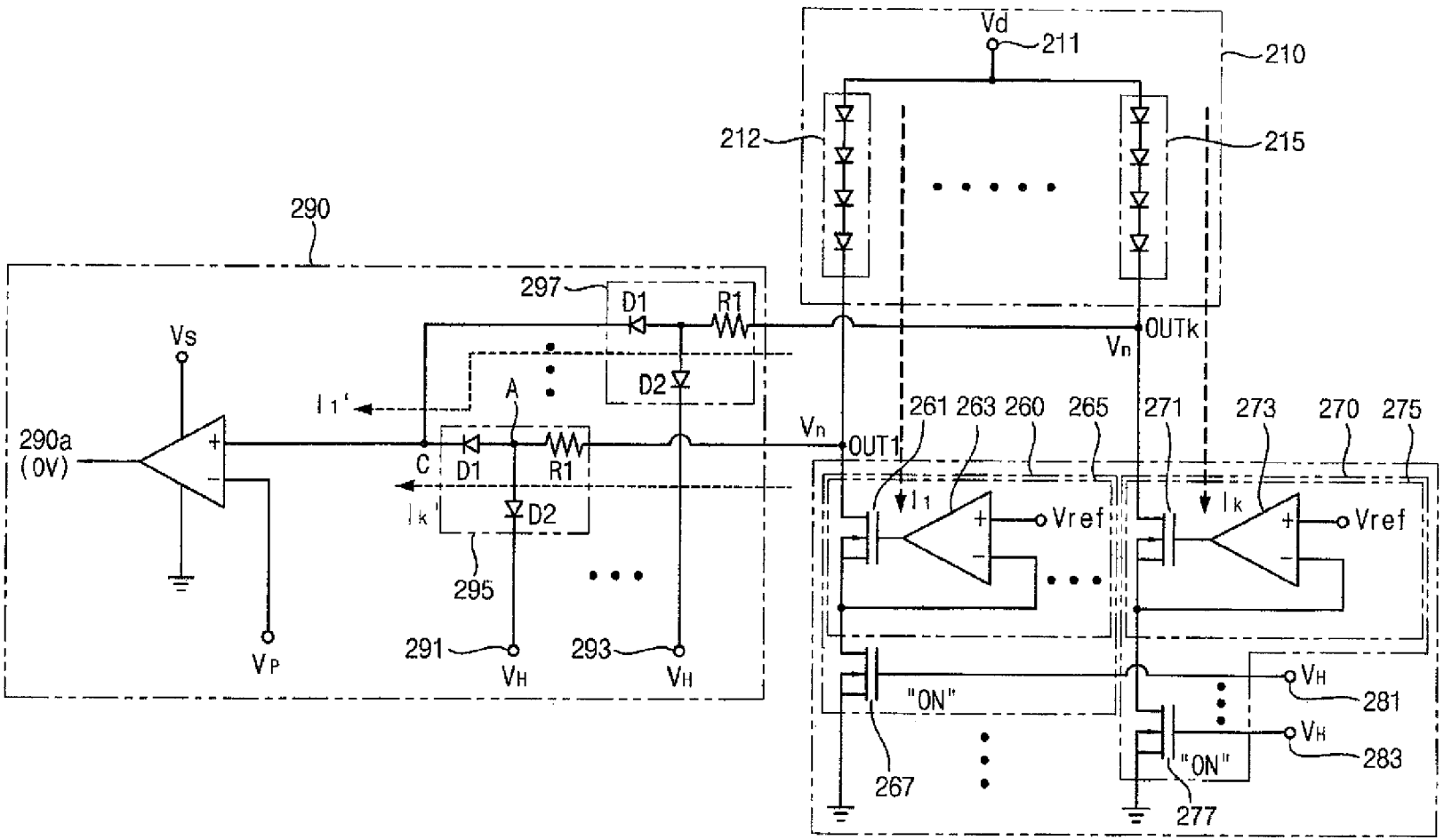
FIGS. 6A and 6B are circuit diagrams illustrating a normal light source device.
Figure 6B:
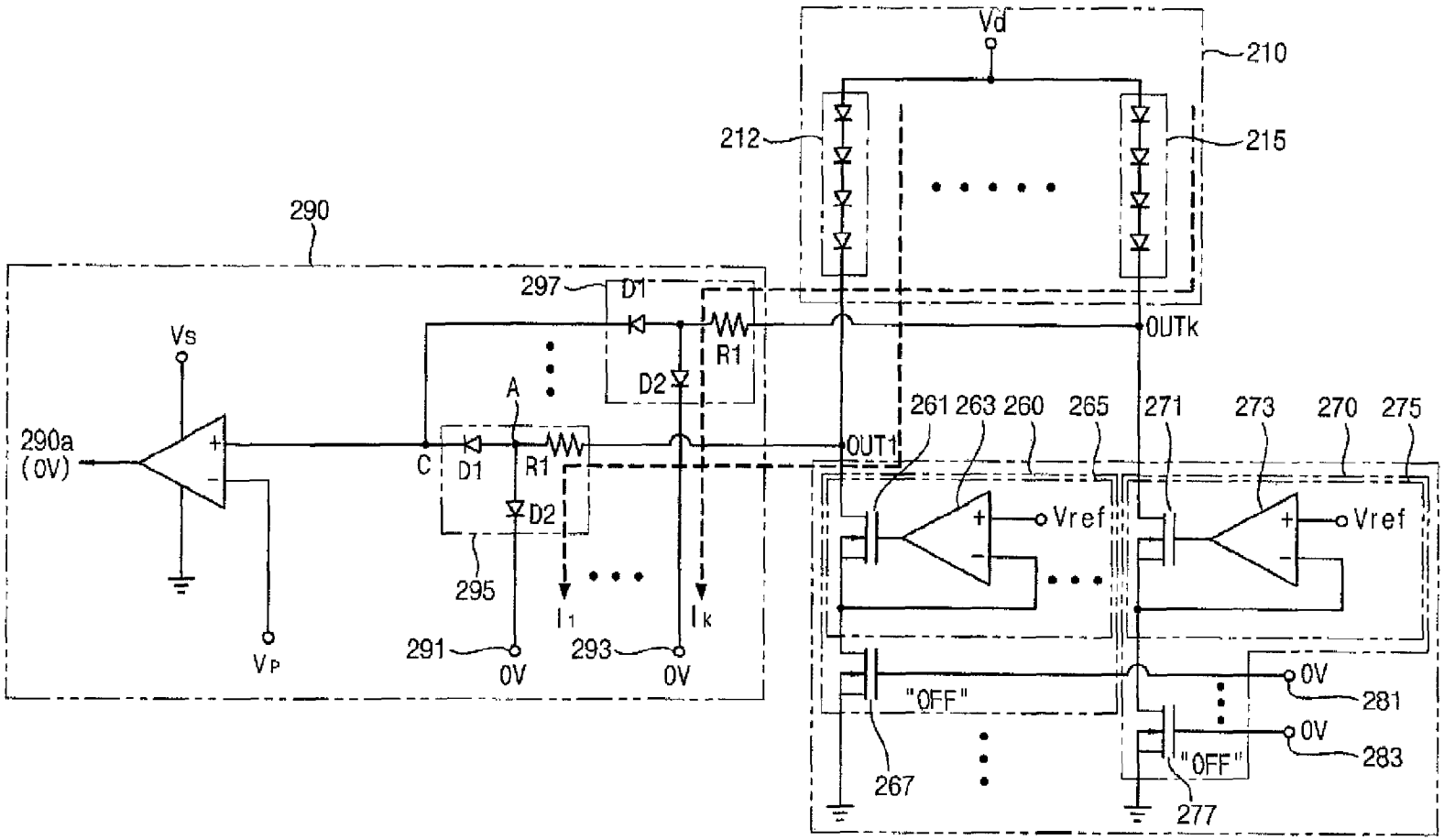
Figure 7:
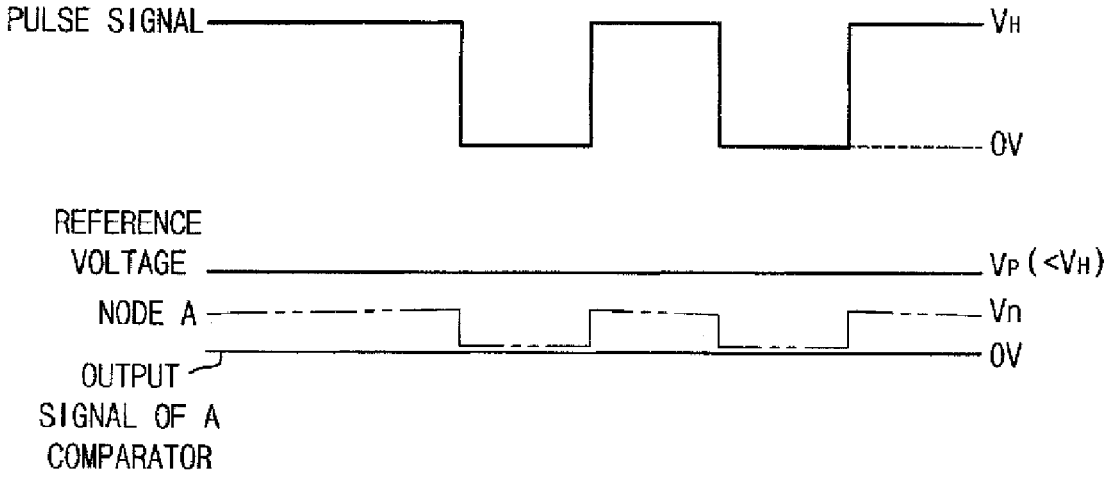
FIG. 7 is a waveform diagram illustrating an input signal and an output signal of the normal light source device.

FIG. 6A and FIG. 6B are circuit diagrams illustrating a normal light source device with no short-circuited LEDs, and FIG. 7 is a waveform diagram illustrating an input signal and an output signal of the normal light source device.

Referring to FIG. 6A and FIG. 6B, the light source 210 includes the normal first and (k)-th LED strings 212 and 215. The first and (k)-th LED strings 212 and 215 of the light source 210 receive the driving voltage Vd.

The input terminals 281 and 283 of the multichannel current controller 280 receive pulse signals at the same time. Additionally, the pulse signals are also provided to the input terminals 291 and 293 of the defect detector 290 at substantially the same time.

Initially, referring to FIG. 6A and FIG. 7, the operation of the light source device will be described when a first pulse signal and a (k)-th pulse signal having a high voltage VH are respectively provided to the light source device based on the first and (k)-th LED strings 212 and 215.

The first and (k)-th driving transistors 267 and 277 of the first control circuit 260 that is electrically connected to the first and (k)-th LED strings 212 and 215 receive the first and (k)-th pulse signals having a high voltage VH. Accordingly, the first and (k)-th driving transistors 267 and 277 are turned on. Thus, the first and (k)-th LED strings 212 and 215 operate and generate light.

The first and (k)-th current control circuits 265 and 275 that are electrically connected to the first and (k)-th LED strings 212 and 215 control resistance variation between the first and (k)-th LED strings 212 and 215 so that the first and (k)-th driving current I1 and Ik flowing through the first and (k)-th LED strings 212 and 215 are substantially identical. In this exemplary embodiment, the first and (k)-th current control circuits 265 and 275 compensate for the small resistance variation between the first and (k)-th LED strings 212 and 215 because the first and (k)-th LED strings 212 and 215 may have no short-circuit defects.

The first and second detection circuits 295 and 297 electrically connected to the output terminals OUT1 and OUTk of the first and (k)-th LED strings 212 and 215 receive the first and (k)-th pulse signals having a high voltage VH. Accordingly, most of the first and (k)-th driving currents I1 and Ik flowing through the first and (k)-th LED strings 212 and 215 flows through to the ground connection of the first and (k)-th control circuits 260 and 270.

Minute currents I1' and Ik' may flow through the first and (k)-th detection circuits 295 and 297, and voltage Vn at the output terminals OUT1 and OUTk is normal. For example, the voltage at node A in the first detection circuit 295 may be almost identical with the normal voltage Vn. The normal voltage Vn is within the allowable voltage range that is less than the first reference voltage Vp of the comparator 299.

Therefore, the comparator 299 outputs the voltage control signal 290*a* having a low voltage of about 0 V when the normal voltage Vn, which is less than the first reference voltage Vp, is inputted to the comparator 299. Thus, the light source 210 may operate normally.

Hereinafter, referring to FIGS. 6B and 7, the operation of the light source device will be described when the first and (k)-th pulse signals having a low voltage of about 0 V are provided to the light source device based on the first and (k)-th LED strings 212 and 215.

The first and (k)-th driving transistors 267 and 277 of the first and (k)-th control circuits 260 and 270 that are electrically connected to the first and (k)-th LED strings 212 and 215 receive the first and (k)-th pulse signals having a low voltage of about 0 V. Accordingly, the first and (k)-th driving transistors 267 and 277 are turned off. Thus, the first and (k)-th LED strings 212 and 215 may not generate light. The first and second detection circuits 295 and 297 that are electrically connected to the output terminals OUT1 and OUTk of the first and (k)-th LED strings 212 and 215 receive the first and (k)-th pulse signals having a low voltage of about 0 V.

The driving voltage Vd is discharged through the first and (k)-th LED strings 212 and 215, the second diodes D2 in the first and (k)-th detection circuits 295 and 297, and the input terminals 291 and 293 forming current routes I1 and Ik. For example, a voltage at the node A in the first detection circuit 295 is almost 0 V.

Therefore, voltages at the output terminals OUT1 and OUTk are almost 0 V as detected from the first and (k)-th detection circuits 295 and 297. The comparator 299 outputs the voltage control signal 290*a* having a low voltage of about 0 V when the detected voltage is about 0 V that is within the allowable voltage range. The voltage generator 230 generates the driving voltage Vd based on the voltage control signal 290*a* having a low voltage of about 0 V to operate the first and (k)-th LED strings 212 and 215.

According to exemplary embodiment the present invention, short-circuit defects of the LEDs may be detected in real time when the light source device operates. The light source device and the display device including the light source device may be protected by blocking the driving voltage provided to the light source when the short-circuit defects are generated at the light source.

Having described exemplary embodiments of the present invention and their advantages, it is noted that various changes, substitutions and alterations can be made herein without departing from the spirit and scope of the invention as defined by appended claims.

What is claimed is:

1. A method of driving light sources, the method comprising:

controlling amounts of light generated from light-emitting diode (LED) strings based on pulse signals operating the LED strings connected in parallel;

synchronizing voltages with the pulse signals at output terminals of the LED strings to detect the voltages, wherein the output terminals of the LED strings are connected to control circuits to control resistance variations between the LED strings; and stopping the operation of the LED strings when the detected voltages at a common node coupled to each of the output terminals of the LED strings are out of a predetermined allowable voltage range.

2. The method of claim 1, wherein a voltage of the output terminal of the LED string is boosted when at least one LED of the LED strings is shorted.

3. The method of claim 1, wherein the allowable voltage range is set according to a selected number of shorted LEDs.

4. A light source device comprising:

a light source including a plurality of LED strings connected in parallel;

a pulse generator generating a plurality of pulse signals controlling amounts of light generated from the plurality of LED strings;

a multichannel current controller being connected to output terminals of the plurality of LED strings to control resistance variations between the plurality of LED strings, the multichannel current controller controlling the amounts of light generated from the LED strings based on the plurality of pulse signals;

a defect detector connected to the output terminals of LED the plurality of strings, the defect detector being synchronized with the pulse signals to detect short-circuit defects in the plurality of LED strings, and a voltage generator providing the plurality of LED strings with a driving voltage, wherein the defect detector controls the voltage generator to prevent the driving voltage from being provided when the short-circuit defects are detected, and wherein the defect detector comprises:

a plurality of detection circuits including first terminals respectively connected to the output terminals of the plurality LED strings, and a plurality of input terminals receiving the pulse signals; and a comparator comprising:

a first input terminal commonly connected to second terminals of the detection circuits at a common node and receiving a detected voltage, a second input terminal receiving a first reference voltage, and an output terminal providing a voltage control signal.

5. The light source device of claim 4, wherein a voltage corresponding to the output terminals of the plurality of LED strings are boosted when at least one LED of the plurality of LED strings is shorted.

6. The light source device of claim 4, wherein the comparator controls the voltage generator to prevent the driving voltage from being provided when the detected voltage is greater than or equal to the first reference voltage.

7. The light source device of claim 4, wherein a level of the first reference voltage is set in accordance with a selected number of the shorted LEDs.

8. The light source device of claim 4, wherein each of the plurality of detection circuits comprises:

a first resistor connected to the output terminal of the LED string;

a first diode having a cathode connected to the first resistor and an anode connected to the common node;

a second diode having an anode connected to the first resistor and the first diode, and a cathode connected to the input terminal receiving the pulse signal.

9. The light source device of claim 4, wherein the defect detector further comprises a filter circuit connected to the first input terminal of the comparator and the common node to remove noise in the detected voltage provided from the detection circuit.

10. The light source device of claim 4, wherein the multichannel current controller comprises:

a control transistor having a source connected to the output terminal of the LED string;

an operational amplifier having a first input terminal receiving a second reference voltage, a second input terminal connected to a drain of the control transistor, and an output terminal connected to a gate of the control transistor; and a driving transistor having a source connected to the drain of the control transistor, a gate receiving the pulse signal, and a drain connected to ground.

11. A display device comprising:

a display panel displaying a frame image;

a local dimming controller dividing the frame image into blocks and generating a plurality of dimming control signals based on respective luminances of image signals corresponding to the blocks;

a light source including a plurality of LED strings connected in parallel corresponding to the blocks;

a pulse generator generating pulse signals controlling amounts of light from the plurality of LED strings based on the dimming control signals;

a multichannel current controller connected to output terminals of the plurality of LED strings, controlling the amounts of light from the plurality of LED strings based on the pulse signals, and controlling resistance variations among the plurality of LED strings; and a defect detector connected to the output terminals of the plurality of LED strings, and synchronized with the pulse signals to detect short-circuit defects in the plurality of LED strings, and a voltage generator providing a driving voltage to the plurality of LED strings, wherein the defect detector controls the voltage generator to prevent the driving voltage from being provided when the short-circuit defects are detected, and wherein the defect detector comprises:

a plurality of detection circuits including first terminals respectively connected to the output terminals of the plurality of LED strings, and input terminals receiving the pulse signals; and a comparator including a first input terminal commonly connected to second terminals of the detection circuits at a common node and receiving a detected voltage, a second input terminal receiving a first reference voltage, and an output terminal providing a voltage control signal.

12. The display device of claim 11, wherein the comparator controls the voltage generator to prevent the driving voltage from being provided when the detected voltage is greater than or equal to the first reference voltage.

13. The display device of claim 11, wherein a level of the first reference voltage is determined according to a selected number of the shorted LEDs.

14. The display device of claim 11, wherein each of the detection circuits comprises:

a first resistor connected to the output terminal of the LED string;

a first diode having a cathode connected to the first resistor and an anode connected to the common node;

a second diode having an anode connected to the first resistor and the first diode, and a cathode connected to the input terminal receiving the pulse signal.

15. The display device of claim 11, wherein the defect detector further comprises a filter circuit connected to the first input terminal of the comparator and the common node to remove noise in the detected voltage from the detection circuit.

16. The display device of claim 11, wherein the multichannel current controller comprises:

a control transistor having a source connected to the output terminal of the LED string;

an operational amplifier including a first input ten final receiving a second reference voltage, a second input terminal connected to a drain of the control transistor, and an output terminal connected to a control terminal of the control transistor; and a driving transistor having a source connected to the drain of the control transistor, a gate receiving the pulse signals, and a drain connected to ground.

* * * * *